United States Patent [19]

Huf et al.

[11] 3,938,919

[45] Feb. 17, 1976

[54] ROTARY PISTON MACHINE OF TROCHOIDAL CONSTRUCTION

[75] Inventors: Franz Huf, Constance; Jurgen Lambrecht, Ebenhausen, both of Germany

[73] Assignee: Dornier System GmbH, Germany

[22] Filed: Jan. 29, 1975

[21] Appl. No.: 545,184

[30] Foreign Application Priority Data

Feb. 5, 1974 Germany ..... 2405307

[52] U.S. Cl. ..... 418/183; 418/189

[51] Int. Cl.[2] ..... F04C 29/08

[58] Field of Search ..... 418/180, 183, 189

[56] References Cited

UNITED STATES PATENTS

| | | | |
|---|---|---|---|
| 2,155,756 | 4/1939 | Firestone et al. | 418/180 X |
| 3,320,899 | 5/1967 | Von Thuengen et al. | 418/180 X |

FOREIGN PATENTS OR APPLICATIONS

| | | | |
|---|---|---|---|
| 52,457 | 1910 | Switzerland | 418/180 |

*Primary Examiner*—William L. Freeh
*Assistant Examiner*—Leonard Smith
*Attorney, Agent, or Firm*—James E. Bryan

[57] ABSTRACT

This invention relates to an improvement in a rotary piston machine of trochoidal construction for compressing a gaseous medium having working chambers between a trochoidal piston and a housing corresponding to the coordinated outer envelope curve, said working chambers being separated from each other by radial seals in the housing, and outlet openings closed-off by means preventing backflow for discharging medium from the working chambers, the improvement comprising trough-shaped recess means in the peripheral piston surface which, in the dead center position of the piston, are positioned immediately ahead of a radial seal.

6 Claims, 5 Drawing Figures

ROTARY PISTON MACHINE OF TROCHOIDAL CONSTRUCTION

The present invention relates to a rotary piston machine of trochoidal construction for compressing gaseous media, comprising working chambers formed between a trochoidal piston and a housing corresponding to the coordinated outer envelope curve, which working chambers are separated from each other by radial seals in the housing whereby the medium is conveyed from the working chambers by way of outlet openings closed off by means of check valves.

When such rotary piston machines are employed as compressors, there arises the well-known problem of the return expansion which become apparent in a very adverse fashion also in lifting cylinder compressors. The effect of the return expansion is such that, in the harmful space of the compressor, i.e. in the greatly narrowed working chamber on the pressure side inclusive of the discharge openings at the outlet valve, there exists a high pressure which, during further rotation of the piston, must first expand before in the now-increasing working chamber an underpressure will prevail sufficient for suctioning-in a new charge. When uncontrolled valves are used, these valves will therefore open very late because of the return expansion. The delay due to return expansion is 20° and more crankshaft revolution after the dead center position of the piston. This factor represents a considerable loss of usable stroke volume, and volumetric efficiency.

It is the object of the present invention to avoid the adverse effects of the return expansion, and to maintain the usable stroke volume as large as possible.

This object is obtained, according to the present invention, in rotary piston machines of the aforementioned construction by virtue of the fact that positioned on the peripheral piston surface are trough-shaped recesses which, in the dead-center position of the piston, viewed in the direction of rotation of the piston, are positioned immediately ahead of a radial seal. The trough-shaped recesses are advantageously so positioned on the circumferential piston surfaces that the beginning of the trough-shaped recesses is located, in the dead-center position of the piston, at the line of contact of the radial seal with the peripheral piston surface.

A factor contributing to the improvement of the aforementioned effect is that the outlet openings together with the outlet valves — viewed in the direction of rotation of the piston — are positioned in the area ahead of the radial seal closing-off the working chamber in the descending direction. When, in operation, the trough-shaped recesses rotate past the radial seal, there occurs for this short period of time a connection between the pressure side and the suction side. As a result thereof, at least a portion of the medium held under pressure in the harmful space can flow over from the pressure side to the suction side. The high pressure in the harmful space is rapidly reduced thereby, and the new suctioning—in procedure within this working chamber can begin sooner than was heretofore possible.

The particular advantage of the present invention is that not only is the usable stroke volume increased, and therewith the volumetric efficiency improved, but also no portion of the working medium is lost at that time. The portion of the medium flowing from the pressure side over to the suction side is added as an over-charging portion on the suction side to the medium already there present. In this manner not only is the adverse effect of the return expansion avoided entirely, or a significant part thereof, but even an advantageous positive use of the return expansion is effected.

The present invention may be employed in rotary piston machines of the most diversified types. The supply and discharge of the working medium is of no significance therein. The conveyance of the working medium into the working chamber, for example, may take place through openings in the front housing wall and in the housing jacket, or also through known control openings in the front piston wall, whereby these control openings slide past the stationary radial sealing strip and are in connection with supply openings in the housing side wall via channels extending in the piston by way of further openings in the piston side wall. Also the outlet or discharge of the compressed medium from the working chamber may take place, in principle, via openings in the front housing wall and in the housing jacket, or via corresponding control openings in the front piston wall. Here again, the control openings in the front piston wall must be in connection with outlet openings in the housing side wall by means of channels extending in the piston. In this connection, it is always essential that these outlet openings — whether they be in the front housing wall and in the housing jacket, or in the housing side wall — be closed-off by means preventing backflow. The supply and discharge of the working medium by means of the piston referred to hereinabove is known, for example, from British Patent No. 1,022,722, or French Patent No. 1,495,120.

One embodiment of the present invention now will be further described hereinbelow with reference to the accompanying drawings, wherein:

FIG. 1 schematically illustrates a rotary piston machine with a piston in the form of an epitrochoid 2 : 1;

Figure 1:
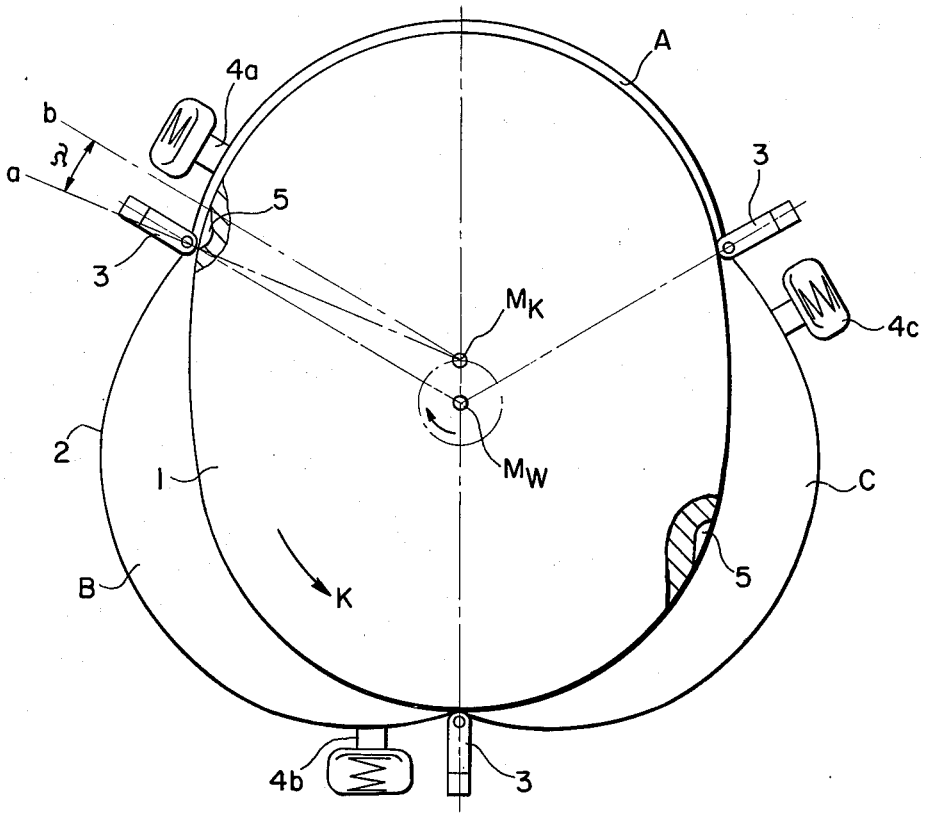

Chosen as the embodiment in FIG. 1 is a rotary piston machine with a piston 1 in the form of an epitrochoid 2 : 1, i.e. in the form of a reniform curve. The principle of the present invention is applicable, however, also to any other trochoidal form. In the example chosen, the piston 1 has alternately par-axis and off-axis zones. The piston center has been designated as $M_K$. The piston center $M_K$ travels, during the operation of the machine, about the axle center $M_W$ of the drive shaft, on the crank circle indicated in dash-dotted lines. The direction of rotation of the drive shaft is indicated with an arrow at the crank circle. The direction of rotation of the piston 1 is opposite to the direction of rotation of the crankshaft and also has been indicated with an arrow and the reference symbol K. The housing 2 surrounding the piston 1 is patterned closely after the outer envelope curve coordinated to the epitrochoid. Thus formed here between the piston 1 and the housing 2 are the three working chambers A, B, and C. These working chambers are separated from each other by the radial seals 3 in the housing 2. In FIG. 1, the piston 1 is positioned in the upper dead-center position in the working chamber A. The working chambers B and C illustrate intermediate positions between the top dead center and the bottom dead center positions of the piston. The supply of the medium is here of secondary importance and therefore has not been shown in this figure. Arranged in each working chamber is an outlet opening with an outlet valve 4*a*, 4*b*, and 4*c*. The harmful space at the outlet openings up to the valve and the coordinated narrow clearance of the working chamber A in the top dead center position of the piston 1 is responsible for the return expansion. As has been mentioned hereinabove, it is advantageous that the outlet valves be positioned as closely as possible ahead of the coordinated radial seal 3 on the descending side of the working chamber.

Arranged in the piston 1 on the peripheral surface thereof are trough-shaped recesses 5. These trough-shaped recesses 5 are so positioned that in the top dead center position of the piston they will be positioned immediately ahead of a radial seal 3. It is clearly apparent from FIG. 1, on the upper left-hand side, that the recess 5 is positioned between the radial seal 3 and the outlet valve 4*a*. Coordinated to each off-axis zone or each arc of the trochoidal piston is an arrangement of trough-shaped recesses 5. These trough-shaped recesses 5 are located in proximity to the end of the arc. For the two-arc epitrochoid illustrated in FIG. 1, two trough-shaped recesses 5 therefore have been shown in the piston. Accordingly, for a three-arc epitrochoid, three such arrangements or groups of recesses 5 would be provided.

Figure 3:
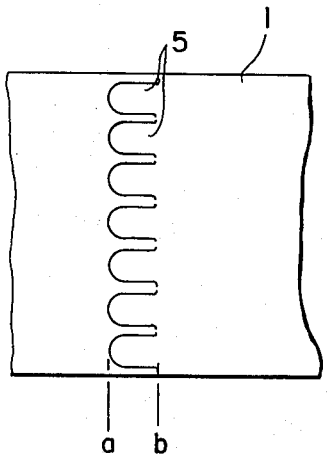
FIG. 3 illustrates a section at an enlarged scale from the circumferential piston surface.

As shown in FIG. 3, not only is a single trough-shaped recess 5 provided on the peripheral piston surface, but an entire row thereof. The beginning of the trough-shaped recesses 5 is positioned at line *a;* the end of the trough-shaped recesses is positioned at line *b*. Lines *a* and *b* also have been shown in FIG. 1 and define there an angle $\lambda$ which thus defines the length of the trough-shaped recesses 5. Line *a* and therewith the beginning of the trough-shaped recesses is advantageously so placed in the top dead center position of the piston 1 that the line *a* extends through the line of contact of the radial seal 3 with the piston surface 1. The trough-shaped recess 5 thus begins at the sealing line which is pivoted out of the plane of the radial seal 3 by the pivot angle $\beta$ in the top dead center position of the piston.

The operation of the trough-shaped recesses 5 is explained with reference to FIG. 2. Shown in this figure is the position of the piston 1 immediately after leaving the top dead center position. After a few degrees of crankshaft rotation, the trough-shaped recess 5 is positioned precisely under the radial seal 3. The momentary pivot angle is designated here as $\beta$. The working chamber A represents itself as a narrow gap or clearance between the surface 1 of the piston and the housing 2. The working chamber B positioned on the other side of the radial seal 3 is still relatively far extended. In the harmful space of the working chamber A, i.e. in the narrow gap or clearance between the piston and the housing, as well as in the bore of the outlet valve 4*a*, which has not been specifically shown in FIG. 2, there still prevails a high pressure of the compressed working medium. In the working chamber B, on the other hand, there prevails a considerably lower pressure of the suctioned-in medium. Through the trough-shaped recesses 5, a part of the medium of high pressure now can flow from the working chamber A into the working chamber B. As a result, the high pressure within the harmful space on the pressure side, i.e. within the working chamber A, is rapidly reduced so that a renewed suctioning-in can there take place much earlier. During the flow-over, no portion of the medium is lost, rather the transferred medium is added in addition to the normal charge in the working chamber B as an overcharging portion.

Figure 2:
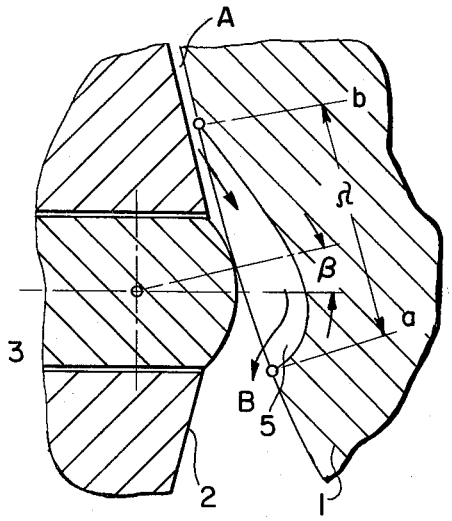
FIG. 2 illustrates a section at an enlarged scale from the area of a radial seal.

Additionally indicated in FIG. 2 are the boundary lines *a* and *b* of the trough-shaped recesses 5, as well as the angle $\lambda$. The form and size of the trough-shaped recesses 5 may be accommodated to the other operating conditions of the machine, i.e. to speed, extent of the return expansion and the like. For the utilization of the return expansion, it is very advantageous when the harmful spaces are positioned as closely as possible at the radial seal of the descending side, as already has been set forth hereinabove. Required as a result are only short flow paths from this harmful space through the trough-shaped recesses 5 to the other working chamber. The pressure compensation takes place rapidly and completely. Due to the form of the troughs 5 with a flat end at line *b*, and a more marked curvature at line *a* there results a good flow-through from the working chamber A to the working chamber B. Toward this end, the curvature of the trough-shaped recesses 5 at line *a* of course need not form an edge with the circumferential piston surface, as has been shown in FIG. 2 for the sake of simplicity, but a small rounding-off or flattening instead may be there provided for.

Figure 4A:
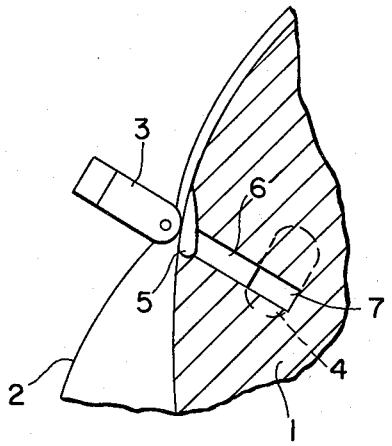
FIGS. 4*a* and 4*b* illustrate the use of the present invention in rotary piston machines with discharge of the working medium through control openings in the piston.
Figure 4B:
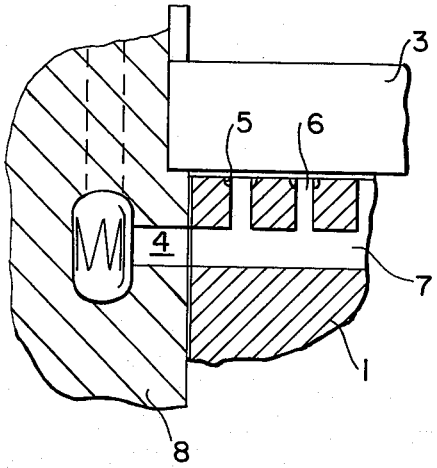

Shown in FIGS. 4*a* and 4*b* is the application of the present invention in rotary pistons with exhaust of the working medium via control openings in the piston 1. For the sake of greater clarity, the construction of the machine has here been represented in a greatly simplified manner. From the trough-shaped recesses 5 in the piston 1, the bores 6 extend into the interior of the piston. These bores 6 like the recesses 5 are distributed over the piston width and are connected with each other, and moreover with the outlet opening 4 arranged in the housing side wall 8 via a channel 7. The outlet opening positioned within the housing side wall 8 is again closed-off by a check valve, as has been indicated in FIG. 4*b*. The outlet line in the housing 8 is shown by dash-dotted lines. The supply path of the working medium is as follows: From the working chamber via the bores 6, the channel 7, the outlet opening 4; and the check valve to the outlet line. Nothing changes in this connection, with respect to the return expansion, in the operation of the trough-shaped recesses 5. The method or manner of the supply of the working medium is without consequence for the present invention.

It will be obvious to those skilled in the art that many modifications may be made within the scope of the present invention without departing from the spirit thereof, and the invention includes all such modifications.

What is claimed is:

1. In a rotary piston machine of trochoidal construction for compressing a gaseous medium having working chambers between a trochoidal piston and a housing corresponding to the coordinated outer envelope curve, said working chambers being separated from each other by radial seals in the housing, and outlet openings closed-off by means preventing backflow for discharging medium from the working chambers, the improvement comprising trough-shaped recess means in the peripheral piston surface which, in the dead center position of the piston, are positioned immediately ahead of a radial seal.

2. A machine according to claim 1 in which, in the dead center position of the piston, the beginning of the trough-shaped recess means is positioned at the line of contact of the radial seal with the peripheral piston surface.

3. A machine according to claim 1 in which the length and cross-section of said trough-shaped recess means correspond to the degrees of angular rotation required in accordance with the respective operating speed of the machine for reducing return expansion at the outlet valves.

4. A machine according to claim 1 in which the trough-shaped recess means are more markedly curved at the leading end thereof than at the trailing end thereof.

5. A machine according to claim 1 in which the outlet openings are positioned in the housing ahead of the radial seals, viewed in the direction of rotation of the piston.

6. A machine according to claim 1 including control openings, terminating in said trough-shaped recess means, for the discharge of the medium, said control openings being adapted to connect with outlet openings, having means preventing backflow therein, in the housing side wall by way of channel means in said piston and terminating in the piston side wall.

* * * * *